US006152313A

United States Patent [19]

Klein et al.

[11] Patent Number: 6,152,313

[45] Date of Patent: Nov. 28, 2000

[54] CLOTHES HANGER WITH SLIDING HOOKS

[75] Inventors: Richard B. Klein, Overland Park; Chris Serslev, Leawood; Farid Nedjam, Lawrence, all of Kans.

[73] Assignee: Lynk, Inc., Lenexa, Kans.

[21] Appl. No.: 08/915,128

[22] Filed: Aug. 20, 1997

[51] Int. Cl.[7] ..... A47F 5/08; A47F 7/28

[52] U.S. Cl. ..... 211/113; 211/85.3; 211/118

[58] Field of Search ..... 211/113, 118, 211/35, 85.3

[56] References Cited

U.S. PATENT DOCUMENTS

| | | | |
|---|---|---|---|
| D. 85,502 | 11/1931 | Wilhelm . | |
| D. 149,112 | 3/1948 | Darby | 211/35 X |
| D. 287,550 | 1/1987 | Tocci . | |
| D. 308,608 | 6/1990 | Arnold . | |
| D. 324,787 | 3/1992 | Evans . | |
| D. 341,500 | 11/1993 | Klein et al. . | |
| D. 354,412 | 1/1995 | Emery . | |
| D. 377,728 | 2/1997 | Klein et al. . | |
| D. 382,434 | 8/1997 | Klein et al. . | |
| D. 411,701 | 6/1999 | Klein et al. | D6/513 |
| D. 419,349 | 1/2000 | Klein et al. | D6/552 |
| 632,409 | 9/1899 | Hallowell . | |
| 790,669 | 5/1905 | Winship . | |
| 873,496 | 12/1907 | Bryant . | |
| 953,130 | 3/1910 | Fellows . | |
| 1,377,444 | 5/1921 | Shoemaker . | |
| 1,674,359 | 6/1928 | Frey . | |
| 1,733,487 | 10/1929 | Hackley . | |
| 1,769,344 | 7/1930 | Hoffmire . | |
| 1,927,997 | 9/1933 | Weston . | |
| 2,008,748 | 7/1935 | Crow . | |
| 2,067,095 | 1/1937 | Pease . | |
| 2,090,108 | 8/1937 | Cicero . | |
| 2,137,029 | 11/1938 | Scholl . | |
| 2,152,192 | 3/1939 | Hoffman . | |
| 2,238,884 | 4/1941 | Hoffman . | |
| 2,276,141 | 3/1942 | Atkinson . | |
| 2,299,021 | 10/1942 | Hoffman . | |
| 2,469,542 | 5/1949 | Becker | 211/35 X |
| 2,504,910 | 4/1950 | Wellington . | |
| 2,506,844 | 5/1950 | Smith . | |
| 2,620,929 | 12/1952 | Sportsman . | |
| 2,682,955 | 7/1954 | Moore . | |
| 3,171,542 | 3/1965 | Jacobs et al. . | |
| 3,339,749 | 9/1967 | Odegaard et al. | 211/85.3 |
| 3,391,793 | 7/1968 | Streuli . | |
| 3,468,426 | 9/1969 | Loewy . | |
| 3,637,084 | 1/1972 | Uitz . | |
| 3,695,190 | 10/1972 | Bucholz . | |
| 3,888,353 | 6/1975 | Leifheit . | |
| 3,913,745 | 10/1975 | Weiss . | |
| 3,974,917 | 8/1976 | Waxamanski . | |
| 3,999,734 | 12/1976 | Gibson et al. . | |
| 4,094,030 | 6/1978 | Saad . | |
| 4,209,098 | 6/1980 | Adams . | |
| 4,245,746 | 1/1981 | Aylor . | |
| 4,383,722 | 5/1983 | Weber . | |
| 4,415,093 | 11/1983 | Livingston | 211/113 |
| 4,457,436 | 7/1984 | Kelley . | |
| 4,474,316 | 10/1984 | Philibert | 211/113 X |
| 4,607,753 | 8/1986 | Radek . | |
| 4,657,148 | 4/1987 | Heng . | |
| 4,673,092 | 6/1987 | Lamson et al. . | |
| 4,678,151 | 7/1987 | Radek . | |

(List continued on next page.)

FOREIGN PATENT DOCUMENTS

| | | |
|---|---|---|
| 530454 | 7/1954 | Belgium . |
| 1462095 | 12/1965 | France . |
| 182925 | 3/1936 | Switzerland . |
| 421425 | 9/1966 | Switzerland . |

*Primary Examiner*—Jerry Redman
*Assistant Examiner*—Erica B. Harris
*Attorney, Agent, or Firm*—Shook, Hardy & Bacon, L.L.P.

[57] ABSTRACT

A door or wall mounted clothes rack includes opposite end brackets which hang on a door and adjustable clothes hooks which slide along a pair of rods extending between the brackets. The hooks can be adjusted as desired along the rods and are prevented from pivoting on the rods. A modified form of the clothes hanger is constructed to attach to a shoe rack already in place on the door.

23 Claims, 2 Drawing Sheets

U.S. PATENT DOCUMENTS

| | | | |
|---|---|---|---|
| 4,688,681 | 8/1987 | Bergeron . | |
| 4,688,687 | 8/1987 | Pryor . | |
| 4,711,419 | 12/1987 | Polosky . | |
| 4,759,440 | 7/1988 | Kolton et al. | 211/113 X |
| 4,765,467 | 8/1988 | Kolton et al. | 211/113 X |
| 4,768,649 | 9/1988 | Kolton et al. | 211/113 X |
| 4,819,814 | 4/1989 | Fogelgren . | |
| 4,825,601 | 5/1989 | Halverson . | |
| 4,832,298 | 5/1989 | Metalf | 211/59.1 X |
| 4,852,838 | 8/1989 | Field | 211/87 X |
| 4,899,971 | 2/1990 | Elkin . | |
| 4,940,150 | 7/1990 | Spengler . | |
| 4,942,498 | 7/1990 | Toussaint . | |
| 5,035,332 | 7/1991 | Stravitz . | |
| 5,048,698 | 9/1991 | Konrad . | |
| 5,054,629 | 10/1991 | Breen . | |
| 5,082,125 | 1/1992 | Ninni . | |
| 5,097,968 | 3/1992 | Gregory . | |
| 5,101,986 | 4/1992 | Holztrager . | |
| 5,101,989 | 4/1992 | Jones . | |
| 5,152,407 | 10/1992 | Massoudnia et al. . | |
| 5,172,816 | 12/1992 | Kline et al. . | |
| 5,405,026 | 4/1995 | Lee et al. | 211/123 |
| 5,415,297 | 5/1995 | Klein et al. . | |
| 5,617,959 | 4/1997 | Klein et al. . | |
| 5,695,073 | 12/1997 | Klein et al. | 211/35 |
| 5,875,902 | 3/1999 | Emery et al. | 211/119 X |

CLOTHES HANGER WITH SLIDING HOOKS

FIELD OF THE INVENTION

This invention relates generally to the field of clothes hangers and deals more specifically with a clothes hanger which can be mounted on a door or wall and which has sliding hooks to permit adjustability in the location of the hanging articles of clothing.

BACKGROUND OF THE INVENTION

Many efforts have been made to maximize the use of storage space and particularly the storage space within clothes closets. Shoeracks, clothes hangers and other types of storage devices have been constructed to be mounted to the inside surface of a closet door in order to take advantage of space that is otherwise not used. The present invention is directed to a door mounted clothes hanger.

One of the principal problems with the known clothes hanging devices is that the space that is available is not used efficiently. Typically, articles of clothing are hung side by side on uniformly spaced hooks. Because the spacing between adjacent hooks is fixed, relatively thin garments are located farther apart than is desirable, and space is thus wasted. Conversely, large or bulky garments may be too close together and overlap with one another. This can make it difficult to remove one garment without inadvertently displacing an adjacent garment from its hook. Also, a number of bulky garments applied to the hanger can overload it and cause it to break.

In the latter respect, structural strength is a necessary feature that has been absent in many prior clothes hanging devices. While light weight is desirable for a number of reasons, adequate strength to avoid breaking during normal use is essential. It is typical for the hooks to be suspended from a rod or other support member which receives the entire weight of all clothes that are hung on the device. Consequently, the rod must have substantial size in order to be able to withstand the loads to which it is subjected. Similarly, each individual hook must have adequate strength to avoid breaking, and the connections between the hooks and their support structure must also be able to withstand the loads applied by the heaviest articles that may be hung on the hooks.

SUMMARY OF THE INVENTION

The present invention is directed to a mounted clothes hanger that is improved in a number of respects over known prior hangers.

The principal object of the invention is to provide a mounted clothes hanger, mounted to an upright surface such as a door or wall, having hooks that can be adjusted sidewardly in order to space them in an optimum arrangement for handling the particular articles that are hung on them. This feature allows the hanger to be "custom tailored" to best handle the different garments that may be applied to it from time to time. Additionally, the spacing can be adjusted to distribute the weight of the clothing as desired, and the spacing can easily be changed to accommodate different garments or different combinations of garments.

The adjustability of the hooks is achieved by constructing the hooks as parts of slide elements that are mounted to rods in a manner allowing the slide elements to be slid along the rods to the desired positions. The rods are secured at their opposite ends to end brackets which are applied to the door or another vertical surface, or to a shoe rack already mounted on the door. By virtue of the sliding arrangement of the hooks, they can be spaced widely apart for bulky items and more closely for small items, thus taking full advantage of the available space. Furthermore, the hooks can be adjusted in order to distribute the weight of the clothing as desired.

Another important object of the invention is to provide a clothes hanger of the character described which exhibits sufficient strength to handle the loads to which it is subjected during use and yet has a light weight. Strength without undue weight is achieved by using two parallel rods to support the sliding hooks, by using thick and sturdy end brackets to hold the ends of the rods, and by providing the slide elements with thick bodies having passages through which the rods extend. The double rod construction in particular provides strength to the clothes hanger. Not only is the load shared between the two rods, but. the load is also spread to two separate places on the sliding hooks and on the end brackets to avoid applying undue stress to any particular area or areas. The rods are arranged one above the other so that the downwardly directed load is shared substantially equally between them. The provision of two rods is also important in that it prevents the hooks from pivoting on the rods and thus maintains each hook in the proper orientation for securely holding clothing hung on it.

Still another object of the invention is to provide a clothes hanger of the character described which can be constructed to hang directly on the top edge of a door or on a shoe rack already mounted on the door. This feature provides versatility in that the hanger can be used by itself or added to a door mounted shoe rack that is already in place. In both cases, full advantage is taken of the adjustability of the hooks and the structural strength of the hanger.

An additional object of the invention is to provide a clothes hanger of the character described which is simple and economical to manufacture and which may be quickly and easily installed without the need for tools or special skills.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAIL DESCRIPTION OF THE INVENTION

Figure 1:
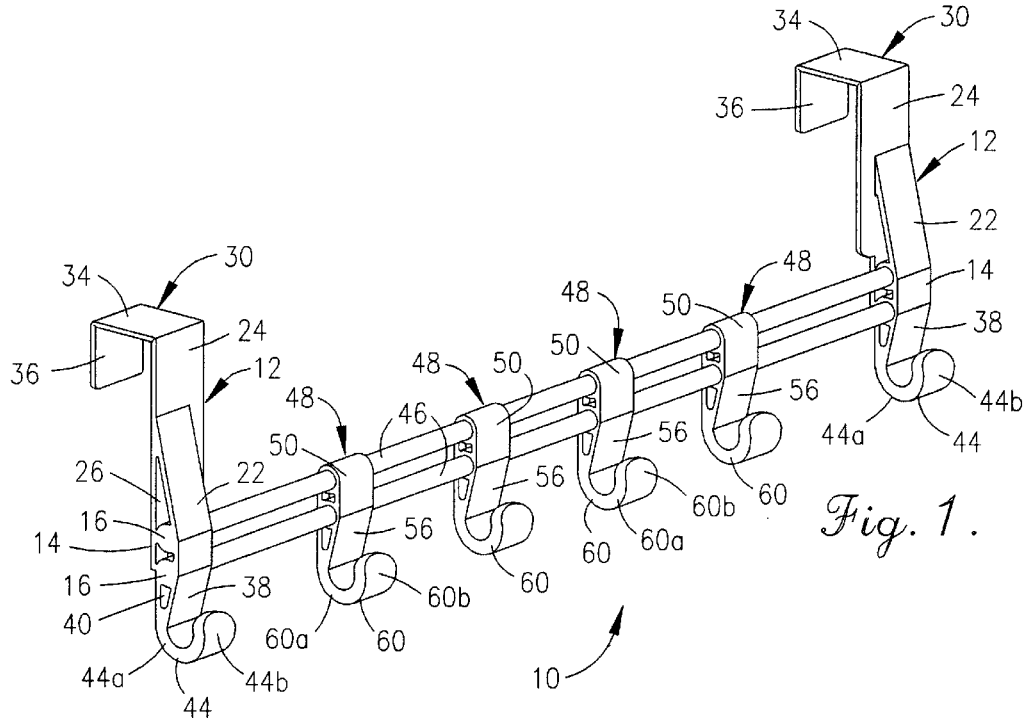
FIG. 1 is a perspective view of a mounted clothes hanger constructed in accordance with one embodiment of the present invention.
Figure 2:
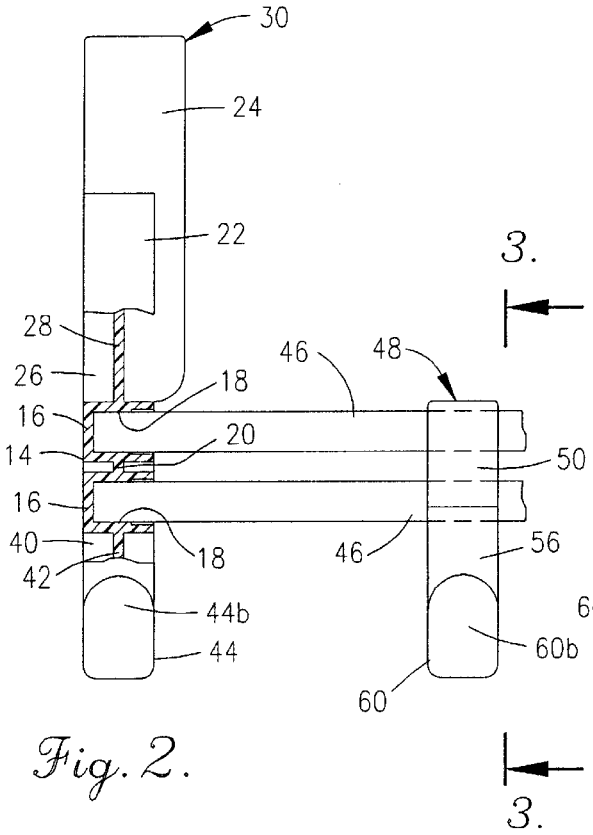
FIG. 2 is a fragmentary front elevational view on an enlarged scale of the left end portion of the clothes hanger shown in FIG. 1, with portions shown in section for purposes of illustration.
Figure 3:
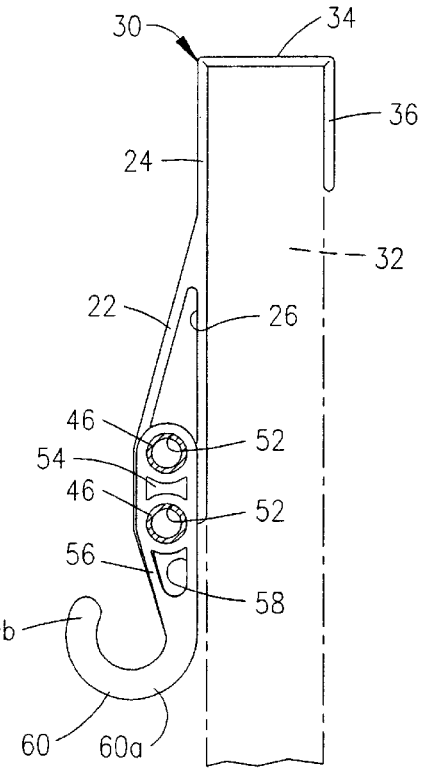
FIG. 3 is a fragmentary sectional view taken generally along line 3—3 of FIG. 2 in the direction of the arrows and showing the clothes hanger applied to the top portion of a door which is depicted in broken lines.

Referring now to the drawings in more detail and initially to FIGS. 1–3, numeral 10 generally designates a clothes hanger constructed in accordance with the present invention. The clothes hanger 10 includes a pair of end brackets 12. The end brackets 12 are constructed similarly, but the left bracket is substantially a mirror image of the right end bracket.

Each end bracket 12 has a relatively thick body 14 near its center. Each of the bodies 14 includes a pair of barrels 16. As shown in FIG. 2, each of the barrels 16 presents a cylindrical recess 18 which is closed by the outside end portion of the barrel. The body 14 is open between the two barrels 16, although the barrels are connected near their centers by a connecting rib 20 (FIG. 2).

Each bracket 12 includes a flat bar 22 which inclines upwardly and rearwardly from the front portion of the body 14 and connects at its top end with a flat strap 24. The lower portion of the strap 24 merges with the back portion of the body 14. An opening 26 is provided between the bar 22 and the strap 24. A gusset 28 within the opening 26 extends between the bar 22 and the strap 24 and also connects with the upper barrel 16 in order to provide structural reinforcement.

The top portion of each strap 24 forms the front of a hanger which is generally identified by numeral 30 and which has the shape of an inverted U in order to be applied over the upper edge of a door 32, as shown in FIG. 3. Each hanger 30 has a horizontal top plate 34 which extends rearwardly from the top edge of strap 24. The back portion of each hanger 30 is formed by a flat flange 36 which extends downwardly from the back edge of the top plate 34. As shown in FIG. 3, the hanger 30 may be hung on the top edge portion of the door 32 in order to mount the bracket 12 on the door. The strap 24 flatly contacts the face of the door on which the bracket is hung, while the top plate 34 spans the upper edge of the door and the flange 36 contacts the opposite face of the door.

A tapered portion 38 each bracket 12 tapers downwardly from the lower barrel 16. Each tapered portion 38 has an opening 40, and the tapered portions are reinforced by gussets 42 (see FIG. 2) located within the opening 40. The tapered portion 38 carries on its lower end a hook 44 having a bight section 44*a* connected with and curving from the tapered portion 38 and an upturned hook end 44*b* extending from the bight 44*a*. The hooks 44 on the end brackets are constructed to allow common articles of clothing to be hung on them.

A pair of identical rods 46 extend between the two end brackets 12. Each rod 46 has a uniform cylindrical shape. As shown in FIG. 2, the ends of the rods 46 are closely received in the recesses 18. The rods 46 are parallel to one another and are located directly above one another when the clothes hanger 10 is hung on the door 32 as shown in FIG. 3. The rods 46 may be hollow as shown or may be solid rods if desired.

The two rods 46 support a plurality of slide elements which are each generally identified by numeral 48 and which are of identical construction. Each slide element includes a relatively thick body 50. A pair of cylindrical passages 52 (see FIG. 3) extend through each of the slide bodies. The passages 52 in each slide body are spaced apart to match the spacing between the rods 46. The rods 46 fit closely through the passages 52, thus mounting the slide elements 48 on the rods 46 while allowing the slide elements to be slid along the lengths of the rods. The close fit of the rods 46 in the passages 52 maintains the slide elements 48 in position until they are intentionally moved. Each slide body 50 presents a small opening 54 in the area between the two passages 52. A rib similar to rib 20 is provided in each of the openings 54 to enhance the strength of each slide body.

Extending downwardly from each slide body 50 is a tapered portion 56 of each slide. Each of the tapered portions 56 is substantially identical to the tapered portion 38 of bracket 12, and each tapered portion is provided with an opening 58 reinforced by a gusset identical to the gusset 42.

Each of the slides 48 is equipped with a hook 60 having a shape identical to hook 44. Each hook 60 includes a curved bight portion 60*a* which extends from the lower end of the tapered portion 56 and an upturned hook end 60*b* connected with the bight 60*a*. The hooks 60 are all aligned with one another and with the hooks 44 in a single row.

In use, the clothes hanger 10 may be mounted on a vertical surface such as the door 32 by hanging the hangers 30 over the upper edge portion of the door as shown in FIG. 3. The close fit of the hangers 30 on the upper edge portion of the door and the extension of the strap 24 flatly along the face of the door provides for a stable connection of the clothes hanger 10 to the door.

The individual slide elements 48 may be slid along the rods 46 to position hooks 60 as desired to receive the particular clothing articles that are to be stored on the hooks. For example, if the hook 60 located closest to the left hand bracket 12 as viewed in FIG. 2 is to receive a relatively bulky article, it can be slid away from the adjacent hook 44 a distance sufficient to clear the garment which is hung on hook 44. Likewise, the adjacent slide element 48 can be slid far enough to the right to accommodate the bulky item. Conversely, hooks which are to receive relatively thin garments can be positioned closely together and still allow the adjacent garments to adequately clear one another. The sliding adjustability of the hooks 60 allows them to be positioned as desired to properly arrange the clothing that is to be hung on the clothes hanger and/or to suitably distribute the weight of the garments so that one side is not unduly weighted down.

The clothes hanger 10 can be provided in any suitable length, and it should be noted that it can be mounted on vertical surfaces other than doors (a wall for example). Virtually any desired number of the slide elements 48 can be provided. The openings such as the openings 26, 40, 54 and 58 reduce the weight of the clothes hanger 10 without creating weakness due to the reinforcement provided by the gussets 28 and 42 and the rib 20.

Figure 4:
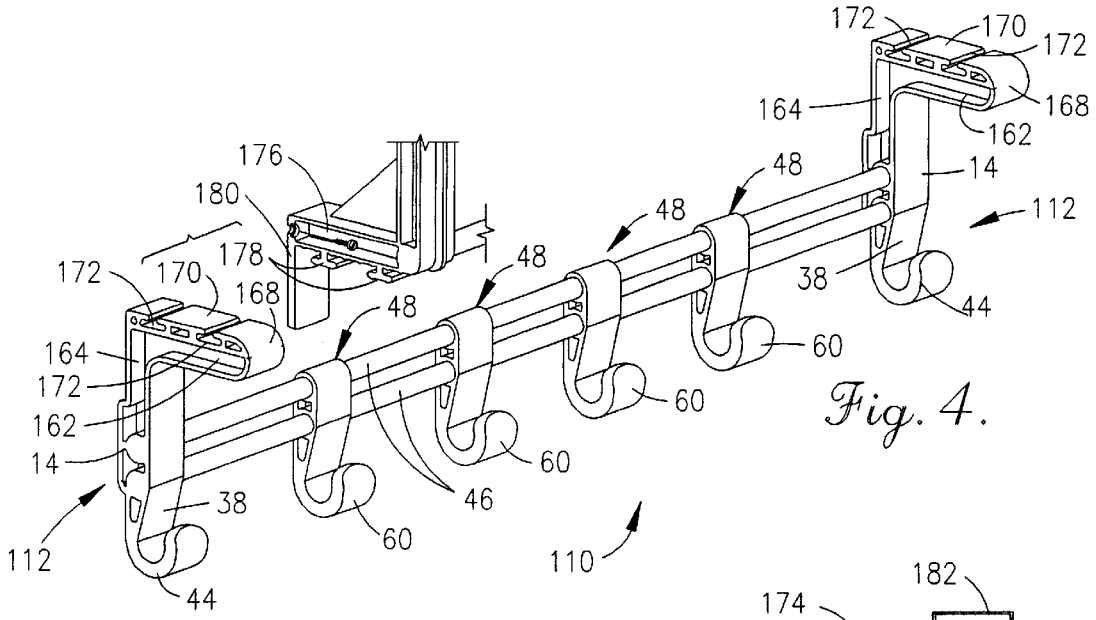
FIG. 4 is a perspective view of a clothes hanger constructed according to another embodiment of the invention, and also showing the bottom portion of a mounted shoe rack to which the hanger may be applied.
Figure 5:
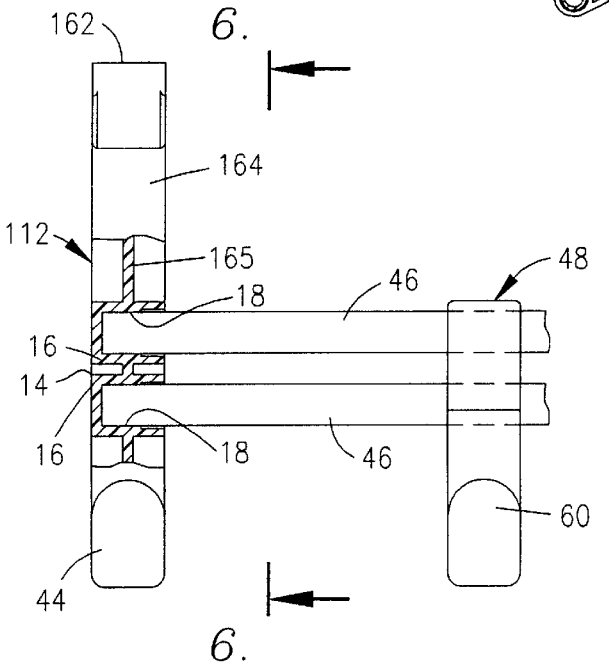
FIG. 5 is a fragmentary front elevational view on an enlarged scale of the left end portion of the clothes hanger shown in FIG. 4, with portions shown in section for purposes of illustration.
Figure 6:
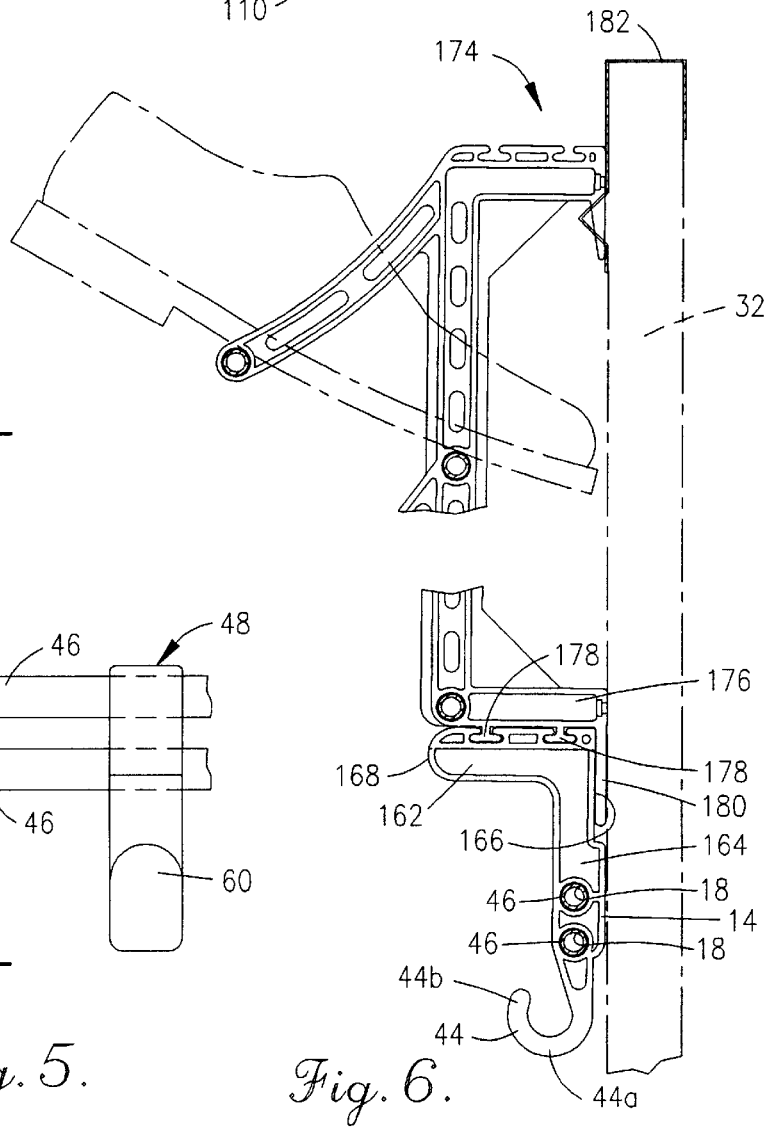
FIG. 6 is a fragmentary sectional view taken generally along lines 6—6 of FIG. 5 in the direction of the arrows and showing the clothes hanger applied to the lower portion of a shoe rack which is shown mounted on a door, with the door and shoe shown in broken lines.

FIGS. 4–6 depict another embodiment of the invention. Numeral 110 generally designates a clothes hanger which is constructed in accordance with the alternative embodiment and which is constructed similarly to the clothes hanger 10 in most respects. The significant difference in the clothes hanger 110 is that it is constructed to be attached to a shoe rack, mounted to a door or wall, rather than directly to the top edge portion of a door as is the case with the clothes hanger 10.

Because the clothes hanger 110 is constructed in many respects identically to clothes hanger 10, components of the hanger 110 that are identical to those of hanger 10 are referred to by the same references numerals used in FIGS. 1–3. Hanger 110 has a pair of end brackets 112, each of which is different on its upper portion from the corresponding bracket 12 but which is identical on its lower portion, including the body 14, the tapered portion 38, and the hook 44. Two rods 46 extend between brackets 112 in a manner identical to the embodiment of FIG. 1, and rods 46 support slide elements 48 having hooks 60 as previously described.

In place of the hanger 30, each bracket 112 is provided with a generally horizontal arm which is generally identified by numeral 162 and which projects forwardly from the upper end of a post 164. The post 164 in turn projects upwardly from and is an integral part of the bracket body 14. The post 164 and arm 162 have an I-beam construction with spaced apart flanges being connected at their center by perpendicular webs such as the web 165 shown in FIG. 5. As best shown in FIG. 6 the post 164 is provided on its upper portion with a recess 166 which recesses the back surface of the post 164 a short distance forwardly from the back surface of the body 14.

The forward or free end of the arm 162 presents a smoothly rounded surface 168 in order to avoid sharp edges or corners. The arm 162 has a horizontal top surface 170 which is flat and which is provided with a pair of spaced apart channels 172 each of which has the shape of an inverted T. The channels 172 extend between the opposite sides of the surface 170 and are parallel to one another.

The clothes hanger 110 is constructed so that it can be attached to a shoe rack which is generally identified by numeral 174. The rack 174 is constructed in the manner shown and described in detail in pending application Ser. No. 630,364 filed on Apr. 19, 1996 in the name of Richard B. Klein, et al., and assigned to Lynk, Inc., which application is incorporated by reference herein.

Reference can be made to the cited application for the details of the shoe rack 174. What is pertinent for purposes of the present application is that the rack 174 has on each of its ends a bottom leg 176 which presents a lower surface having a pair of male elements 178 projecting downwardly from it. Each element 178 has the shape of an inverted T. A flat foot member 180 extends downwardly from the free end of each lower leg 176 and lies flatly against the door 32 when the rack 174 is hung on the door in the manner shown in FIG. 6, using hangers 182 which fit on the top edge portion of the door. The male elements 178 are spaced apart from one another identically to the spacing between the channels 172, and the male members have a size and shape to fit closely within the channels.

The clothes hanger 110 can be attached to the shoe rack 174 by holding the brackets 112 near the feet 176 such that the channels 172 are aligned with the male elements 178. The brackets 112 can then be slid sidewardly such that the male elements 178 are received in the channels 172 in the manner shown in FIG. 6. The close fit of the male elements 178 in the channels 172, together with the inverted T-shape of the male elements and channels, results in the clothes hanger 110 being securely connected with the shoe rack 174 which is in turn securely mounted on the door in the manner described in the cited application Ser. No. 630,364. The recess 166 receives the depending foot 180 so that the back surface of the body 14 is able to contact the face of the door 32.

The clothes hanger may then be used to hang clothes on the hooks 44 and 60 in the manner described in connection with the embodiment of the invention shown in FIGS. 1–3.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An apparatus for receiving hanging articles comprising:

a pair of end brackets for attachment to a support;

a first and a second rod in parallel alignment extending between said end brackets, said rods having a substantially horizontal orientation when said brackets are attached to the support; and a plurality of hooks supported by said rods, wherein each said hook is slidable along said first and second rods independently of the other said hooks, each hook having a body through which said rods extend to mount the hooks for sliding movement along the rods and to prevent the hooks from pivoting about the rods, each hook having an arcuate construction to receive and support a hanging article directly thereon, said construction having a center, wherein said center is disposed substantially vertically below said first and second rods when said brackets are attached to the support.

2. Apparatus as set forth in claim 1, wherein each body includes a pair of passages through which said rods extend to mount the hooks.

3. Apparatus as set forth in claim 1, wherein each of said end brackets includes a hook for receiving a hanging article.

4. Apparatus as set forth in claim 1, wherein each said bracket further comprises a hanger for application to the support in a manner to hang thereon.

5. Apparatus as set forth in claim 1, wherein:

the support to which said end brackets can be attached comprises a shoe rack having a bottom surface. wherein said shoe rack is hung on an upright surface, said shoe rack having connectors thereon; and each end bracket comprises fasteners for mating with said co connectors on said shoe rack.

6. Apparatus as set forth in claim 5, wherein said mating fasteners comprise;

at least one channel extending in each bracket; and a male element for each channel projecting from said bottom surface, said male elements being complemental in shape to said channels and fitting therein to attach the brackets to the shoe rack.

7. Apparatus for attachment to a vertical surface to receive hanging articles, said apparatus comprising:

a pair of end brackets for attachment to said surface;

a pair of substantially parallel rods extending between said brackets, said rods in parallel alignment with one another;

a plurality of slides, each presenting a pair of spaced apart passages through which said rods closely extend to mount the slides for sliding movement along the rods and to prevent pivotal movement of the slides about the rod;

a hook on each slide for receiving a hanging article, wherein each said hook is slidable along said parallel rods independently of the other said hooks, each said hook having a bight portion located generally vertically below said rods when said brackets are attached to the vertical surface; and wherein said slides being supported to slide along and depend from both of said rods.

8. Apparatus as set forth in claim 7, wherein:

each of said end brackets includes a pair of barrels, each barrel presenting a substantially cylindrical recess therein;

each of said rods has a generally circular cross section and generally cylindrical opposite end portions fitting closely in said recesses; and said passages are substantially cylindrical to closely receive the rods.

9. Apparatus as set forth in claim 8, wherein one of said rods is located directly above the other rod.

10. Apparatus as set forth in claim 7 wherein each set of said slides and said hooks, is manufactured as an unitary article.

11. Apparatus as set forth in claim 7, wherein one of said rods is located directly above the other rod.

12. Apparatus as set forth in claim 7, wherein each of said end brackets includes a hook for receiving a hanging article.

13. Apparatus as set forth in claim 12, wherein said hooks on the end brackets are aligned laterally with the hooks on the slides in a single row.

14. A clothes hanger for application to a top edge of a door, said clothes hanger comprising:

a pair of end brackets, each having an upper end portion providing a hanger for application to the top edge of the door to hang the bracket thereon;

a first and second rod extending between said brackets, said rods in parallel alignment with one another;

a plurality of slides mounted on said rods for sliding movement thereon;

a hook on each slide for receiving clothing hung thereon, wherein each said hook is slidable along said first and second rods independently of the other said hooks, said hooks extending generally directly downwardly with respect to said slides when said brackets are hanging from the door; and wherein said slides are supported by and depend from both of said rods.

15. A clothes hanger as set forth in claim 14, wherein each of said slides has a body presenting a pair of passages through which said rods extend to mount the slides for sliding movement along the rods and to prevent the slides from pivoting about the rods.

16. Apparatus as set forth in claim 14, wherein each set of said slides and said hooks is manufactured as an unitary article.

17. A clothes hanger as set forth in claim 14, wherein each end bracket presents a hook for receiving clothing hung thereon.

18. A storage unit comprising:

a first plastic side frame member having a pair of sockets;

a second plastic side frame member having a pair of sockets;

first and second rods extending between said first and second plastic side frame members and positioned in corresponding ones of said sockets wherein said rods are in parallel alignment with each other; and at least one plastic hook slidably mounted on said first and second rods, wherein each said hook is slidable along said first and second rods independently of the other said hooks, and wherein each said hook has a pair of rod receiving channels formed therein for receiving a respective one of said rods, each said hook further having a bight portion located below said rod.

19. The modular storage unit as set forth in claim 18, each said plastic side frame member further comprising a connector for connecting to a support.

20. The modular storage unit as set forth in claim 18, each side plastic frame member further comprising a hanger for hanging on a support.

21. A modular storage unit for positioning on an upright surface comprising:

a first storage unit of a first type, said first storage unit having first and second side frame members with at least one storage element of a first type therebetween, and having an upper end and a lower end, said first storage unit for positioning on the upright surface; and a second storage unit of a second type having first and second side frame members with at least one storage element of a second type therebetween, said second storage unit coupled with said lower end of said first storage unit.

22. The modular storage unit as set forth in claim 21 wherein said first type is a shoe rack.

23. The modular storage unit as set forth in claim 22 wherein said second type is a clothes hanger.

* * * * *